US006599093B2

(12) United States Patent
Totsuka

(10) Patent No.: US 6,599,093 B2
(45) Date of Patent: Jul. 29, 2003

(54) COMPRESSOR HAVING SPEED AND INTAKE REGULATION VALVE CONTROL

(75) Inventor: Junichiro Totsuka, Kako-gun (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/924,488

(22) Filed: Aug. 9, 2001

(65) Prior Publication Data

US 2002/0021969 A1 Feb. 21, 2002

(30) Foreign Application Priority Data

Aug. 10, 2000 (JP) ..... 2000-242542

(51) Int. Cl.[7] ..... F04B 49/20

(52) U.S. Cl. ..... 417/28; 417/26; 417/44.2; 417/307; 417/53

(58) Field of Search ..... 417/26, 28, 44.2, 417/307, 53

(56) References Cited

U.S. PATENT DOCUMENTS

| | | | | | |
|---|---|---|---|---|---|
| 4,664,601 | A | * | 5/1987 | Uchida et al. | 417/27 |
| 5,306,116 | A | * | 4/1994 | Gunn et al. | 415/27 |
| 6,045,331 | A | * | 4/2000 | Gehm et al. | 417/2 |
| 6,146,100 | A | * | 11/2000 | Broucke | 417/28 |
| 6,174,137 | B1 | | 1/2001 | Nakamura | 417/53 |
| 6,461,112 | B1 | * | 10/2002 | Ohta et al. | 417/26 |
| 2001/0046443 | A1 | * | 11/2001 | Van De Putte | 417/44.2 |
| 2002/0034447 | A1 | * | 3/2002 | Brazil et al. | 417/279 |

FOREIGN PATENT DOCUMENTS

| | | |
|---|---|---|
| JP | 5-46797 | 7/1993 |
| JP | 5-52153 | 8/1993 |
| JP | 6-10876 | 1/1994 |

* cited by examiner

*Primary Examiner*—Charles G. Freay
*Assistant Examiner*—Emmanuel Sayoc
(74) *Attorney, Agent, or Firm*—Oblon, Spivak, McClelland, Maier & Neustadt, P.C.

(57) ABSTRACT

A compressor that enables the increase of compression efficiency, the prevention of abnormal temperature rising in the discharge, and the reduction of power loss, includes a compressor body 11, an intake registration valve 12 in the inlet side, and a pressure sensor 18 provided in the discharge side to be able to detect pressure. A control section 22 outputs a control signal for controlling the rotational speed of a motor 21 for driving the compressor body 11 based on a pressure signal indicating a detected pressure from the pressure sensor 18, when the rotational speed is higher than a predetermined value, the intake regulation valve 12 is opened and a control signal for negating a deviation of the detected pressure to the predetermined target pressure is outputted from the control section 22, thereby controlling the rotational speed, and when the rotational speed is reached to the predetermined value, the control is switched to the open/close control for opening/closing the intake regulation valve 12 in response to a pressure fluctuation in the discharge side in place of the rotational speed control, thereby controlling pressure fluctuation in the discharge side. Here, the predetermined value is set to such a value that the leakage quantity of gas, compressed by the screw compressor, into the inlet side of the screw compressor will not be increased as rotational speed of the motor is decreased.

6 Claims, 2 Drawing Sheets

[Fig. 1]
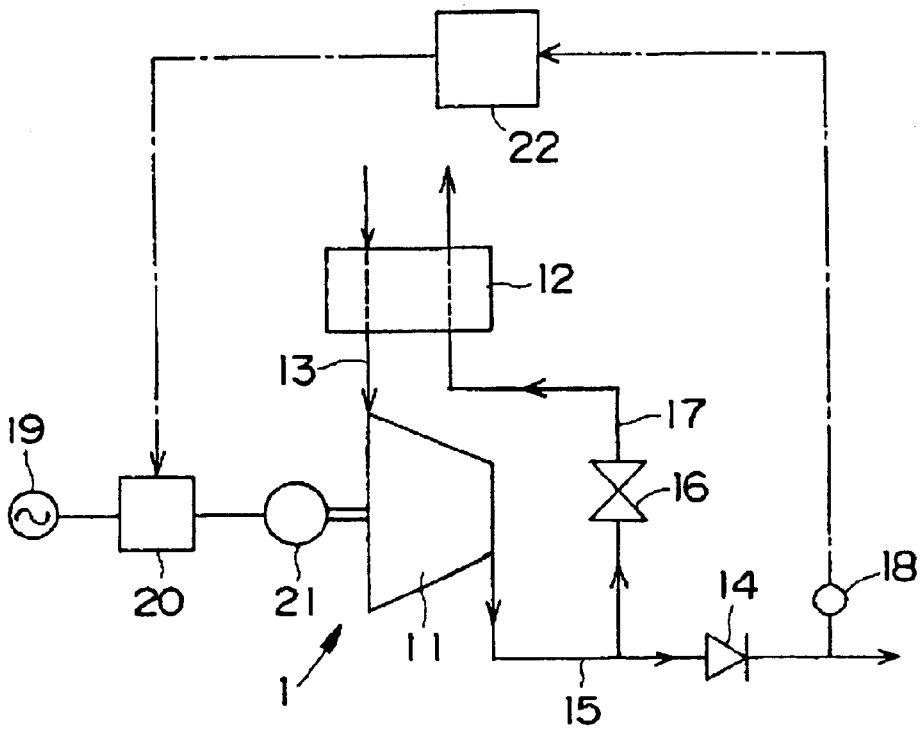
[Fig. 2]
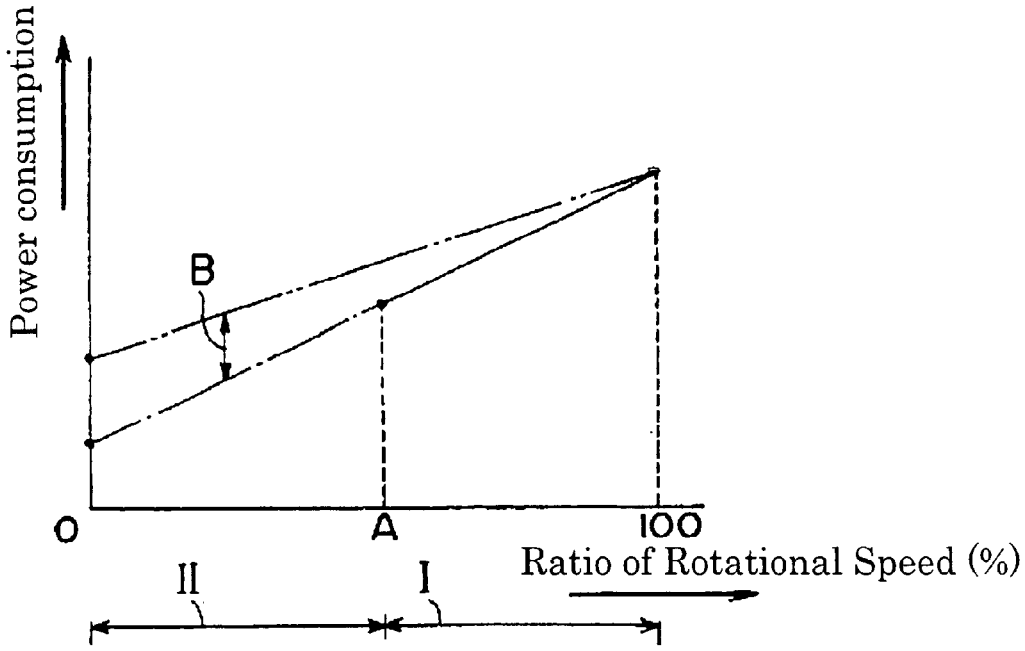

[Fig. 3]
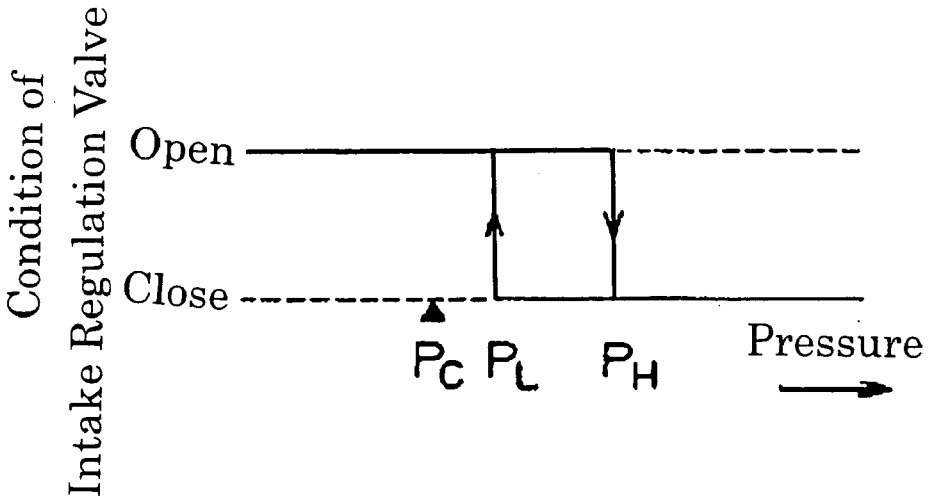
[Fig. 4]
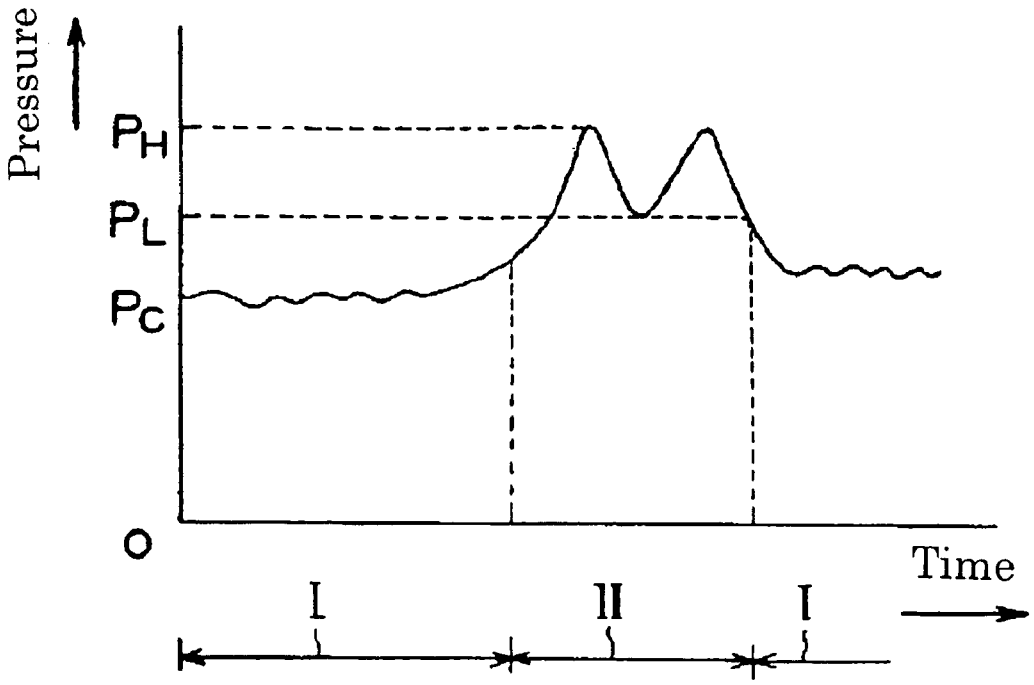

COMPRESSOR HAVING SPEED AND INTAKE REGULATION VALVE CONTROL

BACKGROUND OF THE INVENTION

1. Field of the Invention

The present invention relates to a compressor using a motor as a driving, part, in which a rotational speed control is performed by means of, for example, an inverter, and to its control device and its control method.

2. Description of the Related Art

Conventionally, a method for operating a screw compressor that is adapted to perform a rotational speed control of a motor, which is a driving part of a lubricating type screw compressor body, by means of an inverter has been well known, as disclosed in Japanese Laid-Open Patent Publication Hei 6-10876. The screw compressor comprises a capacity control system including a P1 control unit, a pressure regulation valve and the inverter, besides an intake throttle valve in the inlet side of the lubricating type screw compressor body and a pressure sensor provided at the discharge side of the lubricating type screw compressor body so that it can detect a pressure.

According to the above operating method, a capacity control that maintains the pressure by means of the rotation speed control is performed in the case where a pressure detected by the pressure sensor rises, the rotational speed of the motor decreases through the PI control unit and the inverter, whereas the pressure drops, the rotational speed of the motor increases. However, the rotational speed control using the inverter and P1 control unit is discontinued just before the inverter is tripped by an overload in the course of decreasing the rotational speed, and then the rotational speed control is switched to a capacity control for maintaining the pressure to be constant by means of intake regulation: the capacity control opens the pressure regulation valve, and decreases the opening of the intake throttle valve when the pressure rises whereas increases the opening when the pressure drops. By such an operating method, energy saving and the like have been attempted.

Further, another method for operating a screw compressor has also been adopted conventionally that performs a capacity control by means of a loading/unloading control operating, wherein an intake regulation valve and a gas release valve are provided at the inlet side and discharge side of a screw compressor body, respectively, and the capacity control closes the intake regulation valve and opens the gas release valve when the pressure in the discharge side rises, whereas opens the intake regulation valve and closes the gas release valve when the pressure in the discharge side drops.

According to the method for operating the screw compressor disclosed in the Japanese Patent Laid-Open Hei 6-10876, the rotational speed of a motor is adapted to be decreased to the time just before the inverter is tripped if the pressure in the discharge side raises. Accordingly, the rotational speed is sometimes excessively decreased, so that a problem is caused in that the leakage quantity of gas, compressed within the screw compressor body, into the inlet side may be increased and the compression efficiency may be decreased. The increase of leakage quantity is especially eminent in a non-lubricating type screw compressor with gaps between screw rotors and between screw rotors and walls of rotor chambers being not oil-sealed, rather than in a lubricating type screw compressor with the gaps being oil-sealed. In addition, there is also a problem in that abnormal temperature rising is caused in the discharge side as the leakage quantity is increased.

Meanwhile, in the method for operating the screw compressor that performs the loading/unloading control operating, there is a problem in that its mechanical loss is large and its efficiency is poor in view of power consumption.

SUMMARY OF THE INVENTION

The present invention is conceived to eliminate such problems of the prior art and it is an object of the present invention to provide an apparatus for controlling a compressor that enables the increase of compression efficiency, the prevention of abnormal temperature rising in the discharge side, and the reduction of power loss.

In order to solve the above problem, the present invention is a compressor comprising: a compressor body that is driven by a motor; a motor control mechanism for controlling the rotational speed of said motor; a pressure detector for detecting a discharge pressure of said compressor body; an intake regulation valve provided at the inlet side of said compressor body; and a control operation unit that outputs a motor rotational speed command signal to said motor control mechanism and outputs an open/close command signal to said intake air regulating valve, wherein when the rotational speed commanded to said motor control mechanism is not lower than a predetermined threshold, said control operation unit outputs the motor rotational speed command signal to said motor control mechanism, as it outputted the open signal to said intake regulation valve, so that said discharge pressure will be maintained at a predetermined target pressure, based on the pressure signal from said pressure detector, and when the rotational speed commanded to said motor control mechanism is lower than said threshold, said control operation unit outputs the open/close signal to said intake regulation valve in a state that the rotational speed of said motor is being maintained at about said threshold, so that said discharge pressure will be maintained at the predetermined target pressure, based on the pressure signal from said pressure detector. Here, said threshold is set to such a value that the leakage quantity of gas compressed by said screw compressor, into the inlet side of said screw compressor will not be increased as the rotational speed of said motor is decreased.

In other word, said threshold is set to a value which is sufficiently larger than a rotational speed at which said motor trips.

As to the relationship with the rated rotational speed of motor, it is quite preferable for said threshold to be set 30% or more of the rated rotational speed of said motor.

According to the above construction, it is possible to realize the increase of compression efficiency, the prevention of abnormal temperature rising in the discharge side, and the reduction of power loss, because the rotational speed of said motor is not excessively decreased in performing a control such as controlling the pressure fluctuation in the discharge side.

In addition, it is possible that said motor control mechanism comprises an inverter.

Moreover, it is quite preferable if said control operation unit performs a proportional integral derivative (PID) control operation based on the deviation from said target pressure of said pressure signal and also has an integration limit in performing the integration calculation, when said control operation unit calculates the motor rotational speed command signal to said motor control mechanism in order to maintain said discharge pressure at the predetermined target pressure based on the pressure signal from said pressure detector.

The present invention is also an apparatus for controlling a compressor that comprises a compressor body driven by a motor and a motor control mechanism for controlling a rotational speed of said motor, the apparatus comprising: a pressure detector for detecting a discharge pressure of said compressor body; an intake regulation valve provided at the inlet side of said compressor body; and a control operation unit that outputs a motor rotational speed command signal to said motor control mechanism and outputs an open/close command signal to said intake air regulating valve, wherein when the rotational speed commanded to said motor control mechanism is not lower than a predetermined threshold, said control operation unit outputs the motor rotational speed command signal to said motor control mechanism, as it outputted the open signal to said intake regulation valve, so that said discharge pressure will be maintained at the predetermined target pressure, based on the signal pressure from said pressure detector, and when the rotational speed commanded to said motor control mechanism is lower than said threshold, said control operation unit outputs the open/close signal to said intake regulation valve, in a state that the rotational speed of said motor is being maintained at about said threshold, so that said discharge pressure in the predetermined target pressure will be maintained at said predetermined threshold, based on the pressure signal from said pressure detector. Here, said threshold is set to such a value that the leakage quantity of gas compressed by said screw compressor into the inlet side of said screw compressor will not be increased as the rotational speed of said motor is decreased.

The present invention is a method for controlling a compressor that comprises a compressor body driven by a motor and a motor control mechanism for controlling a rotational speed of said motor, and is provided with an intake regulation valve in the inlet side thereof, the method comprising steps of: detecting a discharge pressure of said compressor body by means of a pressure detector; comparing the rotational speed currently commanded to said motor control mechanism with a predetermined threshold; and when said commanded rotational speed is not lower than the predetermined threshold, controlling the rotational speed of said motor so that said discharge pressure will be maintained at a predetermined target pressure based on the pressure signal from said pressure detector, as an open signal was outputted to said intake regulation valve, and when said commanded rotational speed is lower than said threshold, performing an open/close control using said intake regulation valve so that said discharge pressure will be maintained at the predetermined target pressure based on the pressure signal from said pressure detector, in a state that the rotational speed of said motor is being maintained at about said threshold. Here, said threshold is set to such a value that the leakage quantity of gas, compressed by said screw compressor, into the inlet side of said screw compressor will not be increased as the rotational speed of the motor is decreased.

BRIEF DESCRIPTION OF THE DRAWINGS

The above and other objects, features and advantages of the present invention will be better understood from the following description taken in conjunction with the accompanying drawings, in which:

FIG. 1 shows the whole construction of a compressor to which the control method according to the present invention is applied;

FIG. 2 shows relationships between a rotational speed of the motor and a power consumption according to the control method of the present invention and according to a conventional control method of compressor;

FIG. 3 shows correlations between pressures for performing the open/close switching of the intake regulation valve; and FIG. 4 shows an example of a condition of pressure fluctuation in the discharge side in the case of the control method according to the present invention.

DETAILED DESCRIPTION OF THE PREFERRED EMBODIMENTS

Next, the embodiments of the present invention will be explained with reference to the drawings.

FIG. 1 shows a compressor 1 to which the control method according to the present invention is applied, for example, a screw compressor, and the compressor 1 includes a non-lubricating type compressor body 11, to the inlet side of which an intake flow channel 13 interposed with an intake regulation valve 12 is connected, and to the discharge side of which a discharge flow channel 15 interposed with a check valve 14 is connected. From a portion of the discharge flow channel 15 in the first side of the check valve 14, a gas release flow channel 17 interposed with a gas release valve 16 is branched, and in a portion of the discharge flow channel 15 in the second side of the check valve 14, a pressure sensor 18 is provided for detecting the pressure in this portion. Gas in the gas release flow channel 17 is released via the intake regulation valve 12. In addition, the non-lubricating type compressor body 11 is driven by a motor 21 that is supplied with electric power from a power supply source 19 via an inverter 20.

A pressure signal indicating a pressure detected by the pressure sensor 18 is inputted into a control section 22 that comprises, for example, an PID control circuit, and a control signal is outputted from the control section 22 into the inverter 20 based on the pressure signal and a predetermined target pressure. As described herein below, a capacity control of the compressor 1 is performed for controlling the pressure fluctuation in the discharge side by controlling the rotational speed of the motor 21.

Next, a control method according to the present invention to be applied to the compressor 1 will be described.

The compressor 1 is started under the condition that the intake regulation valve 12 is opened and the gas release valve 16 is closed and the compressed gas is transmitted to the discharge flow channel 15. The pressure detected by the pressure sensor 18 tends to rise when the rotational speed of the motor is increased, for example, at the time of starting and when the demand of compressed gas in the second side of check valve 14 is decreased, whereas it tends to drop when the demand of compressed gas is increased.

The control section 22 that received the pressure signal from the pressure sensor 18 is formed to perform, for example, a PID control to maintain the pressure of the discharge side to be constant, calculates a differential pressure between the pressure detected by the pressure sensor 18 and the target pressure, and outputs a control signal to the inverter 20 when the detected pressure is not more than the target pressure, so that the rotational speed of the motor will be increased by a value proportional to the absolute value of the differential pressure.

Furthermore, in the case where the rotational speed of the motor is maintained at a value above a predetermined value, for example 50% of rated rotational speed, a control signal is outputted to the inverter 20 to decrease the rotational speed of the motor by a value proportional to the absolute value of the differential pressure, if the detected pressure is higher than the target pressure.

The above is the case where the rotational speed control is performed using the inverter 20.

In contrast, in the case where the rotational speed of the motor is decreased to a predetermined lower limit, for example, 50% of rated rotational speed, this rotational speed of the motor is maintained as it is and the control is switched to that using the intake regulation valve 12, in order to avoid problems, such as the reduction of compression efficiency due to the increase of leakage quantity of compressed gas into the lower pressure side in the non-lubricating type compressor body 11, which is caused by excessive decrease of rotational speed of the motor. That is, when the detected pressure is lower than the target pressure, the intake regulation valve 12 is opened to raise the discharge pressure, whereas when the detected pressure is higher than the target pressure, the intake regulation valve 12 is closed to lower the discharge pressure.

In this manner, when the rotational speed of the motor is decreased to the predetermined lower limit, a control by opening/closing the intake regulation valve 12, i.e., a loading/unloading control is performed.

The threshold, 50% of rated rotational speed is set to such a value the leakage quantity of gas, compressed by said compressor into the inlet side of said screw compressor will not increased as the rotational speed of said motor is decreased. According to the above construction, it is possible to prevent the oil leakage through the seal, for example, a viscoseal which is formed around the rotorshaft between said motor 21 and said compressor body 11.

However, it is preferred for the intake regulation valve 12 to have a construction that renders it to be in a throttling condition, in which flow rate of intake gas is somewhat maintained, rather than to be zero, even if it is closed under the loading/unloading control, in order to prevent the inlet side of the non-lubricating type compressor body 11 from being a vacuum condition (the condition lower than the atmospheric pressure). Further, if the velocity of pressure rise in the discharge side is high, the gas release valve 16 is opened, thereby releasing the compressed gas in the discharge side from there and an abnormal rise of pressure in the discharge flow channel 15 is prevented.

Further, if the control section 22 performs the PID control, it is preferred to provide the integration limit. If it is not possible to provide this integration limit, it will take a lot of time for the rotational speed of the motor to be increased, and the reduction of pressure will be caused so that the operation may be unstable, when the pressure is lower than the target pressure which results in returning to the control by means of the inverter 20. However, if the integration limit is provided, such deficiencies can be avoided.

FIG. 2 shows a relationship between rotational speed ratio (%) with respect to the rated rotational speed of a motor, which is a driving part of a compressor, and power consumption of the motor. In the drawing, the solid line in the region I shows the relationship in the case of the rotational speed control in the compressor 1 related to the present invention, the one-dot chain line in the region II similarly shows the relationship in the case of the loading/unloading control, the two-dot chain line shows the relationship in the case of loading/unloading control which have been widely adopted heretofore, and the point A on the abscissa indicates the lower limit, for example 50(%). And, FIG. 2 shows that power is saved by the operating method according to the present invention to an extent indicated by the arrow B as compared to the operating method of prior art.

However, it is required to prevent hunting of the intake regulation valve 12 from being produced when performing an open/close control of the intake regulation valve 12. Due to this, a first pressure threshold $P_H$ which is higher than the target pressure $P_C$ and a second pressure threshold $P_L$ which is lower than the first pressure threshold $P_H$ are previously set. As shown in FIG. 3, under the condition that the intake regulation valve 12 is opened, the pressure in the discharge side is raised and reached to the first pressure threshold $P_H$, then the intake regulation valve 12 is closed, and under the condition that the intake regulation valve 12 is closed, the pressure in the discharge side is lowered and reached to the second pressure threshold $P_L$, then the intake regulation valve 12 is opened. In this manner, a hysteresis loop is formed between pressures that switch the open/close of the intake regulation valve 12, whereby the hunting can be prevented.

In this case, because the pressure of discharge side is controlled to be maintained between the first and second pressure thresholds $P_H$ and $P_L$ rather than at the target pressure $P_C$, as shown in FIG. 4, it is preferred that the second pressure threshold $P_L$ has a value near the target pressure value $P_C$.

In addition, although the present invention is very suitable controlling method to a compressor provided with a non-lubricating type screw compressor body, the applicable subject is not limited to this.

What is claimed is:

1. A compressor comprising:

a compressor body that is driven by a motor;

a motor control mechanism for controlling the rotational speed of said motor;

a pressure detector for detecting a discharge pressure of said compressor body;

an intake regulation valve provided at the inlet side of said compressor body; and a control operation unit that outputs a motor rotational speed command signal to said motor control mechanism and outputs an open/close command signal to said intake regulation valve, wherein when the rotational speed commanded to said motor control mechanism is not lower than a predetermined threshold, said control operation unit outputs the motor rotational speed command signal to said motor control mechanism, as the control operation unit outputs the open signal to said intake regulation valve, so that said discharge pressure will be maintained at a predetermined target pressure, based on the pressure signal from said pressure detector, and when the rotational speed commanded to said motor control mechanism is lower than said threshold, said control operation unit outputs the open/close signal to said intake regulation valve, in a state that the rotational speed of said motor is being maintained at about said threshold, so that said discharge pressure will be maintained at the predetermined target pressure, based on the pressure signal from said pressure detector, and wherein said threshold is set to such a value that the leakage quantity of gas, compressed by said compressor, into the inlet side of said compressor will not be increased as the rotational speed of said motor is decreased.

2. A compressor comprising:

a compressor body that is driven by a motor;

a motor control mechanism for controlling the rotational speed of said motor;

a pressure detector for detecting a discharge pressure of said compressor body;

an intake regulation valve provided at the inlet side of said compressor body; and a control operation unit that outputs a motor rotational speed command signal to said motor control mechanism and outputs an open/close command signal to said intake regulation valve, wherein when the rotational speed commanded to said motor control mechanism is not lower than a predetermined threshold, said control operation unit outputs, the motor rotational speed command signal to said motor control mechanism, as the control operation unit outputs the open signal to said intake, regulation valve, so that said discharge pressure will be maintained at a predetermined target pressure, based on the pressure signal from said pressure detector, and when the rotational speed commanded to said motor control mechanism is lower than said threshold, said control operation unit outputs the open/close signal to said intake regulation valve, in a state that the rotational speed of said motor is being maintained at about said threshold, so that said discharge pressure will be maintained at the predetermined target pressure, based on the pressure signal from said pressure detector, and wherein said threshold is set to a value which is 30% or more of rated rotational speed of said motor.

3. The compressor according to claim 1, wherein said motor control mechanism comprises an inverter.

4. The compressor according to claim 1, wherein a PID control operation is performed based on the variation from said target pressure of said pressure signal when said control operation unit calculates the motor rotational command signal to said motor regulation mechanism in order to maintain said discharge pressure at the predetermined target pressure based on the pressure signal from said pressure detector, and wherein an integration limit is present in the calculation of the integration control.

5. An apparatus for controlling a compressor that comprises a compressor body driven by a motor and a motor control mechanism for controlling a rotational speed of said motor, the apparatus comprising:

a pressure detector for detecting a discharge pressure of said compressor body;

an intake regulation valve provided at the inlet side of said compressor body; and a control operation unit that outputs a motor rotational speed command signal to said motor control mechanism and outputs an open/close command signal to said intake regulation valve, wherein when the rotational speed commanded to said motor control mechanism is not lower than a predetermined threshold, said control operation unit outputs the motor rotational speed command signal to said motor control mechanism, as the control operation unit outputs the open signal to said intake regulation valve, so that said discharge pressure will be maintained at a predetermined target pressure, based on the pressure signal from said pressure detector, and when the rotational speed commanded to said motor control mechanism is lower than said threshold, said control operation unit outputs the open/close signal to said intake regulation valve, in a state that the rotational speed of said motor is being maintained at about said threshold, so that said discharge pressure will be maintained at the predetermined target pressure, based on the pressure signal from said pressure detector, and wherein said threshold is set to such a value that the leakage quantity of gas, compressed by said compressor, into the inlet side of said compressor will not be increased as the rotational speed of said motor is decreased.

6. A method for controlling a compressor that comprises a compressor body driven by a motor, a motor control mechanism for controlling a rotational speed of said motor, and an intake regulation valve provided at the inlet side thereof, the method comprising steps of:

detecting a discharge pressure of said compressor body by means of a pressure detector;

comparing the rotational speed currently commanded to said motor control mechanism with a predetermined threshold; and when said commanded rotational speed is not lower than the predetermined threshold, controlling the rotational speed of the motor so that said discharge pressure will be maintained at a predetermined target pressure, based on the pressure signal from said pressure detector, as an open signal was outputted to said intake regulation valve, and when said commanded rotational speed is lower than said threshold, performing an open/close control to said intake regulation valve so that said discharge pressure will be maintained at the predetermined target pressure, based on the pressure signal from said pressure detector, in a state that the rotational speed of said motor is being maintained at about said threshold, wherein said threshold is set to such a value that the leakage quantity of gas, compressed by said compressor, into the inlet side of said compressor will not be increased as the rotational speed of said motor is decreased.

* * * * *